US005524976A

United States Patent [19]

Peng

[11] Patent Number: 5,524,976

[45] Date of Patent: Jun. 11, 1996

[54] CABINET FOR STORING CASSETTE TAPE CONTAINERS

[76] Inventor: Jung-Ching Peng, P.O. Box 82-144, Taipei, Taiwan

[21] Appl. No.: 497,983

[22] Filed: Jul. 3, 1995

[51] Int. Cl.[6] ..... A47B 81/06

[52] U.S. Cl. ..... 312/9.46; 211/40; 211/163; 312/135

[58] Field of Search ..... 312/9.45, 9.46, 312/9.48, 9.58, 135, 136, 249.2; 211/40, 58, 131, 144, 163, 165

[56] References Cited

U.S. PATENT DOCUMENTS

| | | | |
|---|---|---|---|
| 1,134,908 | 4/1915 | Romsos | 312/135 |
| 3,568,854 | 3/1971 | Welch | 211/163 |
| 5,439,119 | 8/1995 | Chow | 211/40 |

FOREIGN PATENT DOCUMENTS

| | | | |
|---|---|---|---|
| 0025020 | 11/1902 | Switzerland | 312/135 |

*Primary Examiner*—James R. Brittain
*Assistant Examiner*—Gerald A. Anderson
*Attorney, Agent, or Firm*—Alfred Lei

[57] ABSTRACT

A cabinet for storing cassette tape containers including a base provided with a center with a vertical axle having an annular groove engaged with a retainer ring, a rotating member having four radial legs each formed at an outer end with a conical through hole with a large diameter at an upper end and a small diameter at a lower end, a plurality of balls having a diameter slightly larger than the small diameter of the conical through hole but smaller than the large diameter of the conical through hole, a plurality of plugs each disposed within the conical through hole and having a spherical recess at a lower end thereof located on one of the balls, a plurality of supporting rods having lower ends each vertically mounted in the conical through hole, a plurality of arms having a U-shaped portion and pivotally connected with the supporting rods, and a cover engaged with upper ends of the supporting rods.

1 Claim, 3 Drawing Sheets

CABINET FOR STORING CASSETTE TAPE CONTAINERS

BACKGROUND OF THE INVENTION

1. Field of the Invention

This invention relates to a cabinet for storing cassette tape containers.

2. Description of the Prior Art

For many years, it has been the conventional practice to pre-record music, voice, entertainment renditions, and other data on an endless loop of tape such as magnetic which is carried in a cartridge adapted to be inserted into a suitable play-back mechanism, such as a tape recorder. In some instances, data is recorded on a paper tape carried in a cartridge as a unit. The individual tape cartridges are separate units from the recorder or play-back mechanism and when a particular tape is selected, the cartridge carrying the tape is inserted into the tape recorder so that a drive roller engages with an exposed portion of the tape for driving the tape past a use for many years, space requirements for storing tape cartridges are extremely limited and restricted so that orderly storage of many tape cartridges becomes awkward and creates a problem for the owner.

Therefore, it is an object of the present invention to provide a cabinet for storing cassette tape containers which can obviate and mitigate the above-mentioned drawbacks.

SUMMARY OF THE INVENTION

This invention relates to a cabinet for storing cassette tape containers.

It is the primary object of the present invention to provide a cabinet for storing cassette tape containers which enables a cassette tape to be extracted from the cassette tape container without removing the cassette tape container from the cabinet.

It is another object of the present invention to provide a cabinet for storing cassette tape containers which is easy and convenient to use.

It is still another object of the present invention to provide a cabinet for storing cassette tape containers which is simple in construction.

It is still another object of the present invention to provide a cabinet for storing cassette tape containers which is economic to produce.

It is a further object of the present invention to provide a cabinet for storing cassette tape containers which can store the cassette tape in a secure but convenient manner.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
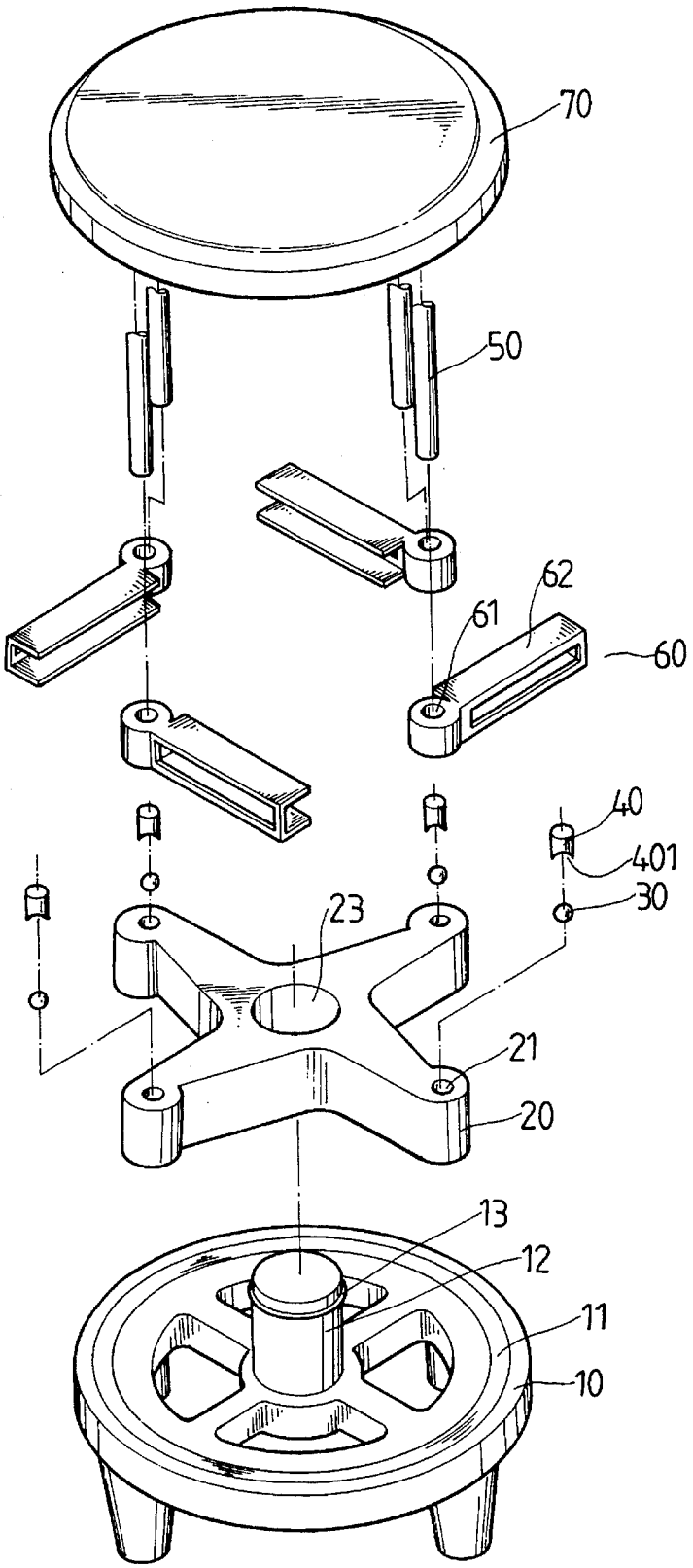
FIG. 1 is an exploded view of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
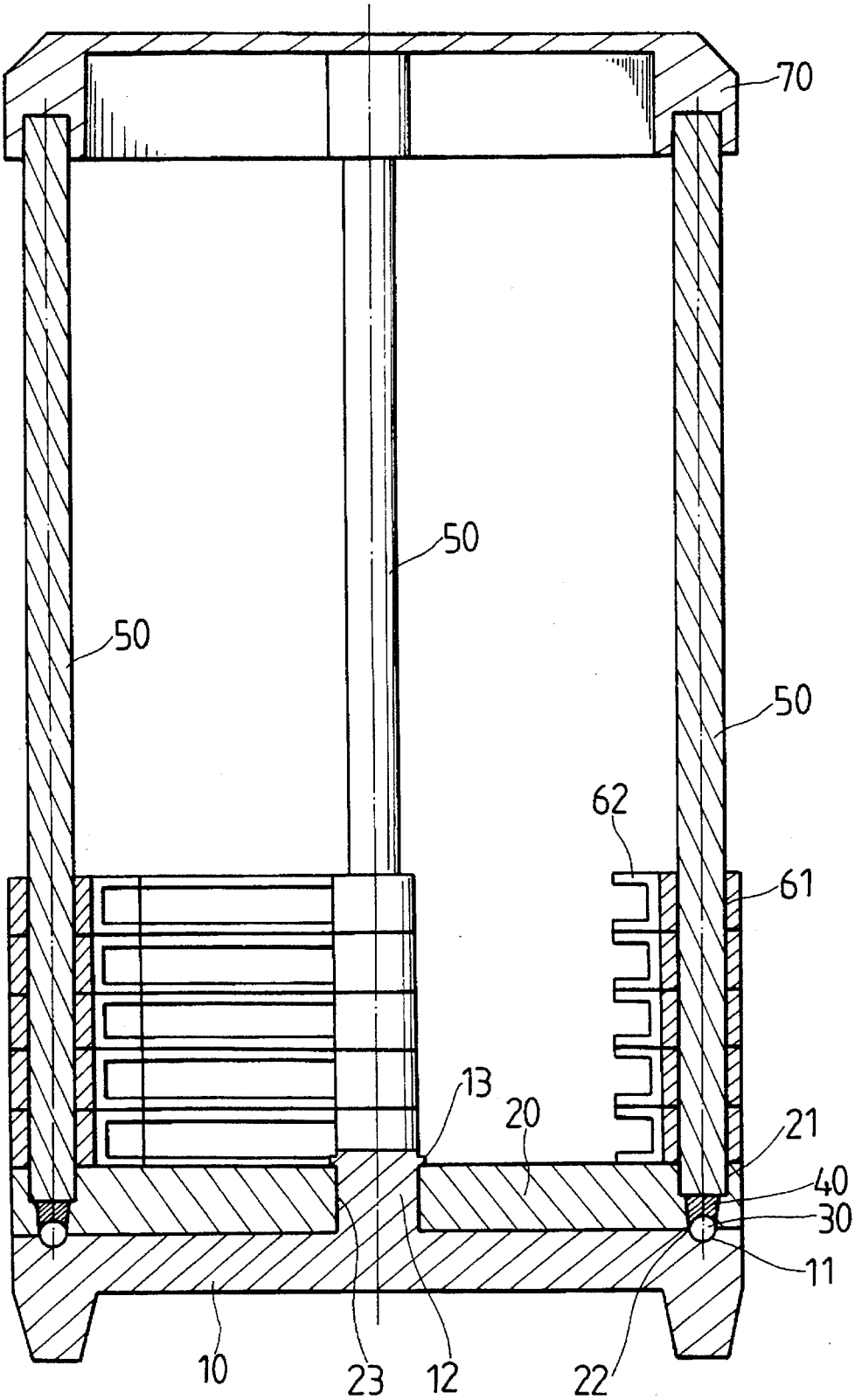
FIG. 2 is a sectional view of the present invention.

With reference to the drawings and in particular to FIGS. 1 and 2 thereof, the cabinet for storing cassettes according to present invention mainly comprises a base 10, a rotating member 20, a plurality of balls 30, a plurality of plugs 40, a plurality of supporting rods 50, a plurality of arms 60, and a cover 70.

As illustrated, the base 10 is a circular member provided at the center with a vertical axle 12 having an annular groove engageable with a retainer ring 13. Further, the base 10 is formed with a circular groove 11 close to its circumference on the upper side thereof.

The rotating member 20 has four legs each formed at an outer end with a conical through hole 21 with a small diameter at the lower portion and a large diameter at the upper portion.

The ball 30 is slightly larger than the small diameter of the conical through hole 21 but smaller than large diameter of the conical through hole 21. The ball 30 is fitted into the conical hole 21 so that the ball 30 partly protrudes downwardly out of the conical through hole 21.

The plug 40 is disposed with the conical through hole 21 and located on the ball 30. The plug 40 is formed at the lower end with a spherical recess 401 so that the ball 30 may rotate smoothly with respect to the plug 40.

The lower end of a rod 50 is vertically inserted in the conical through hole 21 of the rotating member 20, preventing the plug 40 and the ball 30 from disengaging therefrom.

The arm 60 has a U-shaped portion 62 provided at an end with a cylindrical portion having a vertical through hole 61. The supporting rod 50 is vertically inserted through the hole 61 of the arm 60 so that the arm 60 can be rotated with respect to the supporting rod 50.

The cover 70 is provided with a plurality of blind holes adapted to engage with the upper ends of the supporting rods 50.

Figure 3:
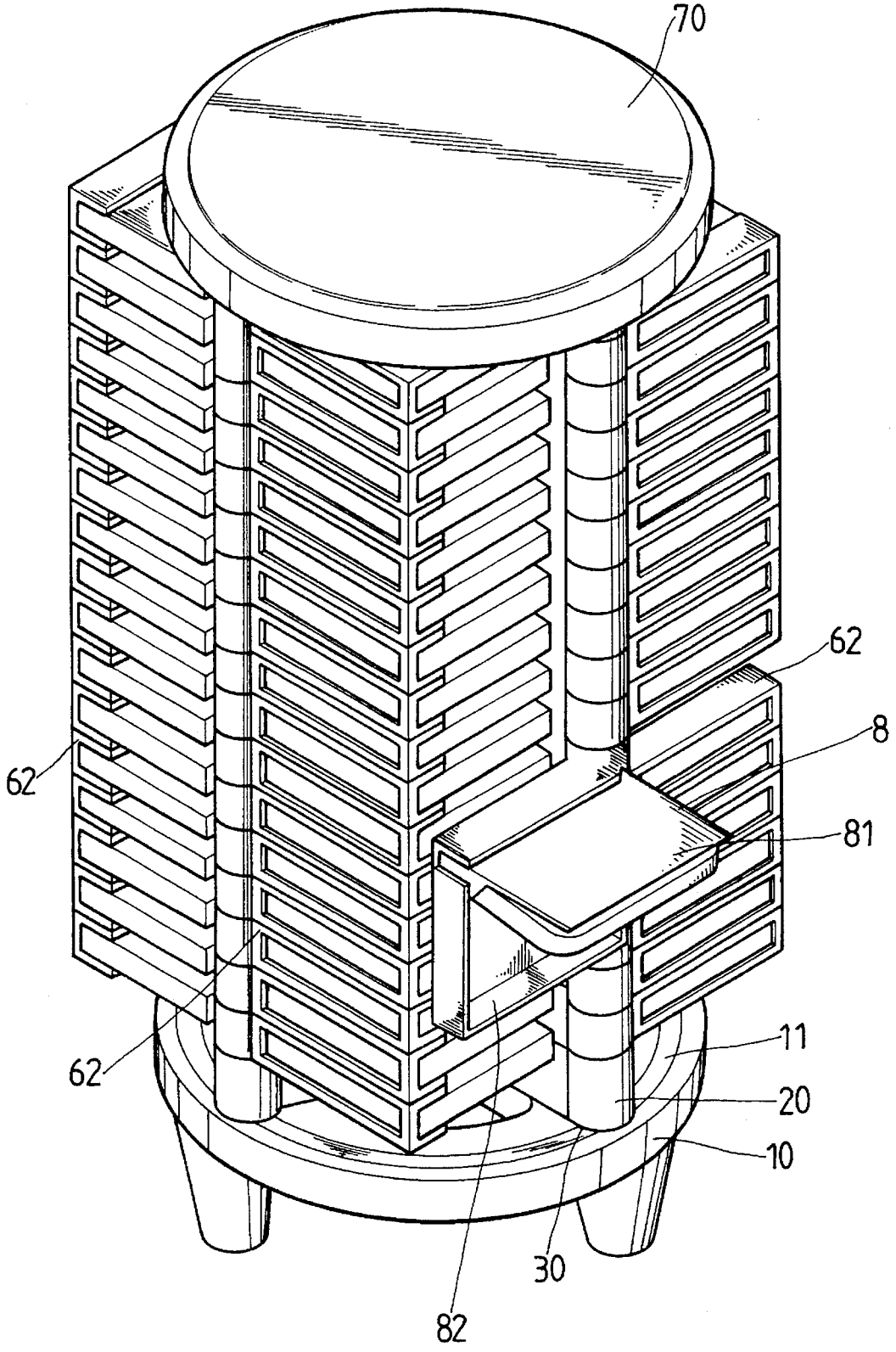
FIG. 3 is a perspective view of the present invention.

When in use (see FIG. 3), the spine of the cassette tape container 8 is fitted in the U-shaped portion 62 of the arm 60, with the top cover 81 at the upper position and the bottom cover 82 at the lower position. Hence, when desired to take out the cassette tape, simply turn out the arm 60 together with the cassette tape container 8 and push down the bottom cover 82 and remove the cassette tape. Hence, the cassette tape can be extracted without removing the cassette tape container from the cabinet and the contents of the cassette tape can be seen from the top cover 81.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A cabinet for storing cassette tape containers comprising:

a base provided with a center with a vertical axle having an annular groove engaged with a retainer ring, said base further having a circular groove close to a circumference on an upper side thereof;

a rotating member having four radial legs each formed at an outer end with a conical through hole with a large diameter at an upper end and a small diameter at a lower end;

a plurality of balls having a diameter slightly larger than the small diameter of said conical through hole but smaller than the large diameter of said conical through hole, said balls being each fitted in said conical through hole and partly protruding downwardly out thereof;

a plurality of plugs each disposed within said conical through hole and having a spherical recess at a lower end thereof located on one of said balls;

a plurality of supporting rods having lower ends each vertically mounted in said conical through hole;

a plurality of arms having a U-shaped portion and pivotally connected with said supporting rods; and a cover engaged with upper ends of said supporting rods.

* * * * *